US009877585B2

(12) United States Patent
Sekine et al.

(10) Patent No.: US 9,877,585 B2
(45) Date of Patent: Jan. 30, 2018

(54) OVERTURN PREVENTING DEVICE AND METHOD OF MOUNTING THE SAME

(71) Applicant: KYB CORPORATION, Minato-ku, Tokyo (JP)

(72) Inventors: Shinichi Sekine, Tokyo (JP); Eiro Fujita, Tokyo (JP); Yasushi Saito, Nagano (JP); Masanori Ogura, Tokyo (JP); Teruhiko Inoue, Tokyo (JP); Kenji Isshin, Tokyo (JP); Keita Abe, Tokyo (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 15/504,523

(22) PCT Filed: Aug. 6, 2015

(86) PCT No.: PCT/JP2015/072335
§ 371 (c)(1),
(2) Date: Feb. 16, 2017

(87) PCT Pub. No.: WO2016/031515
PCT Pub. Date: Mar. 3, 2016

(65) Prior Publication Data

US 2017/0231389 A1 Aug. 17, 2017

(30) Foreign Application Priority Data

Aug. 28, 2014 (JP) ..... 2014-173764

(51) Int. Cl.
*F16M 13/00* (2006.01)
*A47B 97/00* (2006.01)

(52) U.S. Cl.
CPC ..... *A47B 97/00* (2013.01); *A47B 2097/008* (2013.01)

(58) Field of Classification Search
USPC ..... 248/636
See application file for complete search history.

(56) References Cited

U.S. PATENT DOCUMENTS 1,460,771 A * 7/1923 Stoner ..... B60G 11/14 105/106
4,480,731 A * 11/1984 Izeki ..... E04B 1/98 188/130

(Continued)

FOREIGN PATENT DOCUMENTS

JP 2-88546 U 7/1990
JP 3028334 U 9/1998

(Continued)

OTHER PUBLICATIONS

International Search Report for PCT/JP2015/072335, dated Oct. 6, 2015 in English & Japanese Language.

*Primary Examiner* — Monica Millner
(74) *Attorney, Agent, or Firm* — Smith, Gambrell & Russell, LLP

(57) ABSTRACT

Providing an overturn preventing device which can easily be mounted between a top surface of a piece of furniture and a ceiling while an axis line of a damper relative to a vertical direction is inclined at an angle ranging from 15° to 25°. The overturn preventing device includes a damper, a first base portion and a second base portion. The first base portion has a first abutting surface and a first connection. The first base portion is mounted on the top surface of the furniture. The second base portion has a second abutting surface and a second connection. The second base portion is mounted on the ceiling. A relation, X+L sin 15°≤Y≤X+L sin 25°, is obtained where reference symbol X designates a distance from the first abutting surface to the first connection, reference symbol L designates a length of the damper and (Continued)

reference symbol Y designates a distance from the second abutting surface the second connection.

3 Claims, 3 Drawing Sheets

(56) References Cited

U.S. PATENT DOCUMENTS

| | | | | |
|---|---|---|---|---|
| 6,708,940 | B2 * | 3/2004 | Ligertwood | F16M 11/10 248/279.1 |
| 6,840,016 | B1 * | 1/2005 | Mualla | E04H 9/02 52/167.1 |
| 2004/0128921 | A1 * | 7/2004 | Mualla | E01D 11/04 52/167.1 |
| 2009/0283944 | A1 * | 11/2009 | Schordine | B60N 2/502 267/140.11 |

FOREIGN PATENT DOCUMENTS

| | | | |
|---|---|---|---|
| JP | 3139053 | U | 1/2008 |
| JP | 3151821 | U | 7/2009 |
| JP | 2011-161085 | A | 8/2011 |

* cited by examiner

OVERTURN PREVENTING DEVICE AND METHOD OF MOUNTING THE SAME

TECHNICAL FIELD

The present invention relates to an overturn preventing device and a method of mounting the overturn preventing device.

BACKGROUND ART

Patent Document 1 discloses a conventional overturn preventing device. This overturn preventing device is mounted between a top surface of a piece of furniture installed on a floor surface and a ceiling. The overturn preventing device includes a support pillar with a built-in spring and first and second base portions having shafts inserted into both ends of the support pillar respectively. At least one of the first and second base portions is axially movable forward and backward. The spring applies an elastic force to the first and/or second base portion in a direction such that the length of the overturn preventing device is increased. The overturn preventing device is mounted between the top surface of the furniture and the ceiling so that an axis line thereof extends in a vertical direction. As a result, the overturn preventing device can prevent the furniture from being overturned due to quakes of earthquake or the like.

Furthermore, the inventors have found that the furniture can effectively be prevented from being overturned in a case where the axis line of the support pillar with respect to a vertical direction is inclined at an angle ranging from 15° (equal to or larger than 15°) to 25° (equal to or smaller than 25°).

PRIOR ART DOCUMENT

Patent Documents

Patent Document 1: Japanese Utility Model Registration No. 3028334

SUMMARY OF THE INVENTION

Problem to be Overcome by the Invention

In the overturn preventing device of Patent Document 1, in order to mount the overturn preventing device between the top surface of the furniture and the ceiling so that the axis line of the support pillar is inclined at a desired angle with respect to the vertical direction, the first and second base portions may be rotatably connected to the support pillar. However, when the overturn preventing device is to be mounted so that the angle of the axis line of the support pillar with respect to the vertical direction is inclined at an angle ranging from 15° to 25°, a time-consuming work is required in order to confirm and adjust the angle in a temporarily mounted state of the device.

The present invention was made in view of the above-described circumstances in the conventional art and has an object to provide an overturn preventing device which can easily be mounted between the top surface of an article and the ceiling while the axis line of the damper with respect to the vertical direction is inclined at an angle ranging from 15° to 25°, and a method of mounting the overturn preventing device.

Means for Overcoming the Problem

An overturn preventing device of the present invention includes a damper, a first base portion and a second base portion. The damper is mounted between a top surface of an article and a ceiling. The article is installed on an installation surface with a rear surface thereof being opposed to a wall surface extending in a vertical direction from the installation surface. The first base portion has a first abutting surface abutting against the wall surface and a first connection to which one of two ends of the damper is rotatably connected. The first base portion is mounted on one of the top surface of the article and the ceiling. The second base portion has a second abutting surface abutting against the wall surface and a second connection to which the other end of the damper is connected. The second base portion is mounted on the other of the top surface of the article and the ceiling. A distance between the second abutting surface and the second connection of the second base portion is longer than a distance between the first abutting surface and the first connection of the first base portion.

In this overturn preventing device, a relation is expressed by a formula:

$$X+L\sin 15° \leq Y \leq X+L\sin 25° \quad (1)$$

where reference symbol X designates the distance from the first abutting surface to the first connection, reference symbol L designates a length of the damper and reference symbol Y designates the distance from the second abutting surface to the second connection.

In the overturn preventing device of the invention, the first and second base portions may have an identical shape.

A method of mounting the overturn preventing device, of the present invention, includes a first step of mounting one of the first and second base portions on one of the top surface of the article and the ceiling and a second step of mounting the other of the first and second base portions on the other of the top surface of the article and the ceiling. In this method, the first abutting surface of the first base portion and the second abutting surface of the second base portion are caused to abut against the wall surface in the first and second steps.

The article includes furniture, a bed having a plurality of beds connected to each other in the up-down direction, large sized televisions, refrigerators, book shelves, showcases and server racks, all of which have a possibility of being overturned by quakes of earthquake or the like. The installation surface includes not only floor surfaces located inside buildings but also foundation surfaces which are located outside buildings.

BEST MODE FOR CARRYING OUT THE INVENTION

First and second embodiments of the overturn preventing devices of the present invention will be described with reference to the drawings.

First Embodiment

Figure 1:
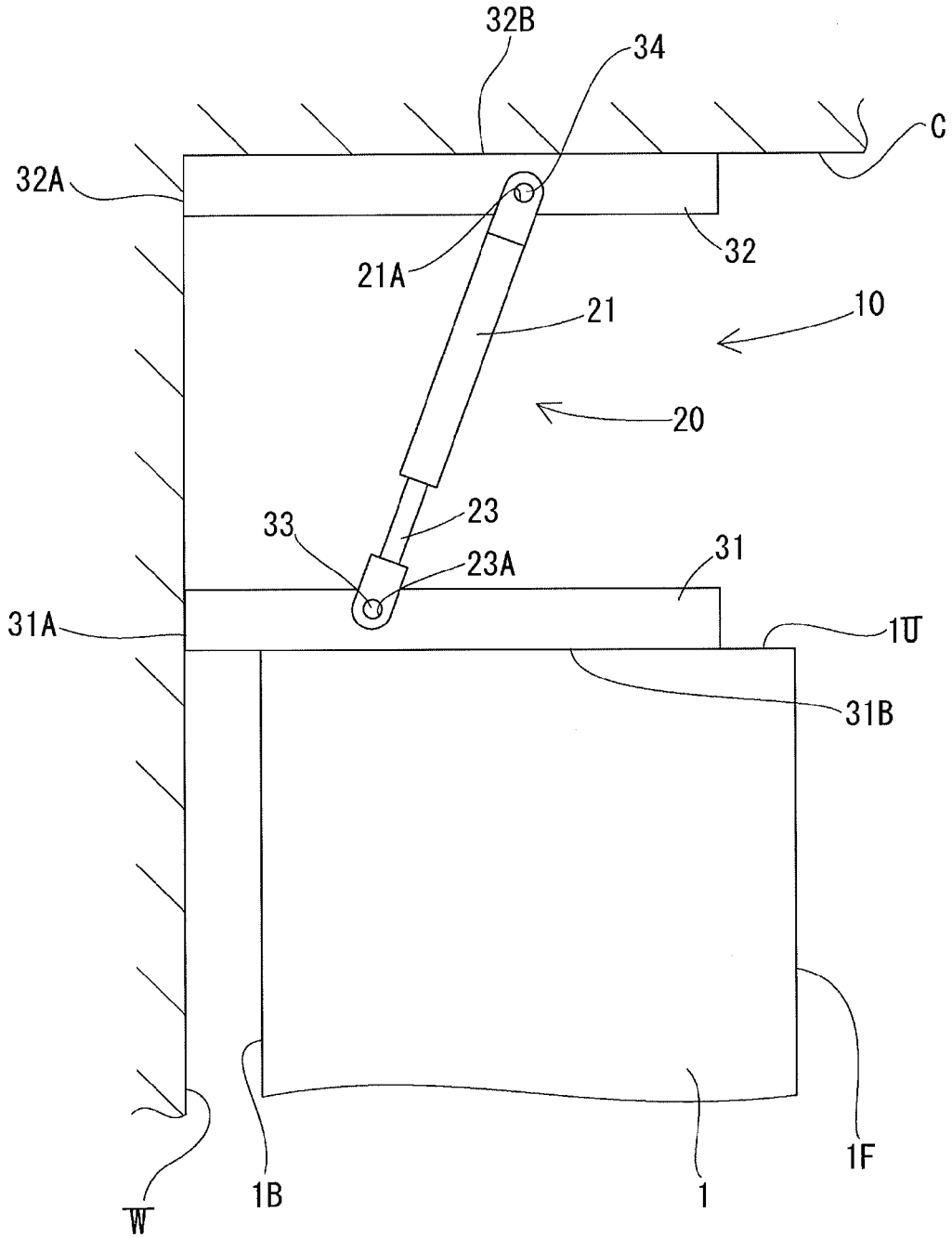
FIG. 1 is a side elevation of the overturn preventing device of first and second embodiments, mounted between a top surface of furniture and the ceiling.

At least one overturn preventing device 10 of the first embodiment is mounted between a top surface 1U of a piece of furniture 1 installed on a floor surface (not shown) and a ceiling C while a rear surface 1B of the furniture 1 is opposed to a wall surface W extending in a vertical direction from the floor surface, as shown in FIG. 1. The furniture 1 is formed into a cuboid shape and has a door, drawers (neither shown) and the like in a front 1F, so that clothes, accessories and the like can be housed in the furniture 1. The furniture 1 has a rectangle-shaped horizontal section long in a right-left direction (a depthwise direction in FIG. 1). When the overturn preventing device 10 is not mounted on the furniture 1, the furniture 1 would possibly be tilted in a front direction (rightward in FIG. 1) by quakes of earthquake or the like thereby to be overturned.

The overturn preventing device 10 includes a damper 20 mounted between the top surface 1U of the furniture 1 and the ceiling C, a first base portion 31 mounted on the top surface 1U of the furniture 1 and a second base portion 32 mounted on the ceiling C.

The damper 20 has a cylinder 21, a piston (not shown), a rod 23 and a rod guide (not shown). The cylinder 21 has a bottomed cylindrical shape. The rod guide closes an opening of the cylinder 21. The piston is slidably inserted into the cylinder 21. The rod 23 has a proximal end connected to the piston and extends through the rod guide. The rod 23 has a distal end side protruding out of the cylinder 21. The cylinder 21 is filled with operating oil and a gas.

The damper 20 is a compression damper in which a damping force generated during an extending operation is smaller than a damping force generated during a compressing operation. The extending operation of the damper 20 refers to an operation which increases an amount of protrusion of the rod 23 out of the cylinder 21 and an entire length of the damper 20. On the other hand, the compressing operation of the damper 20 refers to an operation which reduces an amount of protrusion of the rod 23 out of the cylinder 21 and the entire length of the damper 20.

A mechanism that the damper 20 generates a damping force will be described. Since the mechanism has a known structure, diagrammatic representation is eliminated. The cylinder 21 has an interior divided by the piston into a rod side pressure chamber in which the proximal end of the rod 23 is housed and a counter-rod side pressure chamber. The piston is formed with an orifice which is a throttle valve communicating between both pressure chambers. The orifice functions as a damping force generator which applies resistance to a flow of the operating oil between the rod side pressure chamber and the counter-rod side pressure chamber with the extending/compressing operation of the damper 20. Furthermore, the piston is formed with a communication path communicating via a check valve with both pressure chambers. The check valve allows the operating oil to flow from the rod side pressure chamber to the counter-rod side pressure chamber and blocks reverse flow of the operating oil. Accordingly, the damper 20 has two flow paths of the operating oil from the rod side pressure chamber to the counter-rod side pressure chamber during the extending operation, that is, one flow path including the orifice and the other flow path including the communication path. On the other hand, the damper 20 has only one flow path of the operating oil from the counter-rod side pressure chamber to the rod side pressure chamber through the orifice during the compressing operation. Accordingly, the damping force generated by the damper 20 during the extending operation is smaller than the damping force generated by the damper 20 during the compressing operation.

The first base portion 31 is formed into an elongate shape and has a first abutting surface 31A which abuts against the wall surface W, a furniture side abutting surface 31B which is brought into surface contact with the top surface 1U of the furniture 1, and a first connection 33 to which a distal end of the rod 23 of the damper 20 is connected. The first connection 33 is formed of a shaft member extending in a direction perpendicular to an extension direction of the first base portion 31. The distal end of the rod 23 has an insertion hole 23A into which the shaft member serving as the first connection 33 is inserted in a retained state. The damper 20 is connected to the first base portion 31 rotatably about the first connection 33.

The second base portion 32 has the same elongate shape as the first base portion 31 and includes a second abutting surface 32A which abuts against the wall surface W, a ceiling side abutting surface 32B which is brought into surface contact with the ceiling C, and a second connection 34 to which a proximal end of the cylinder 21 of the damper 20 is connected. The second connection 34 is formed of a shaft member extending in a direction perpendicular to an extension direction of the second base portion 32 and further extending in parallel to the shaft member forming the first connection 33. Furthermore, a distance between the second abutting surface 32A and the second connection 34 is longer than a distance between the first abutting surface 31A and the first connection 33 of the first base portion 31. The proximal end of the cylinder 21 has an insertion hole 21A into which the shaft member serving as the second connection 34 is inserted in a retained state. The damper 20 is connected to the second base portion 32 rotatably about the second connection 34. Since the first and second base portions 31 and 32 have the same shape, the manufacture of the overturn preventing device 10 can be rendered easier with the result of cost reduction.

Figure 2:
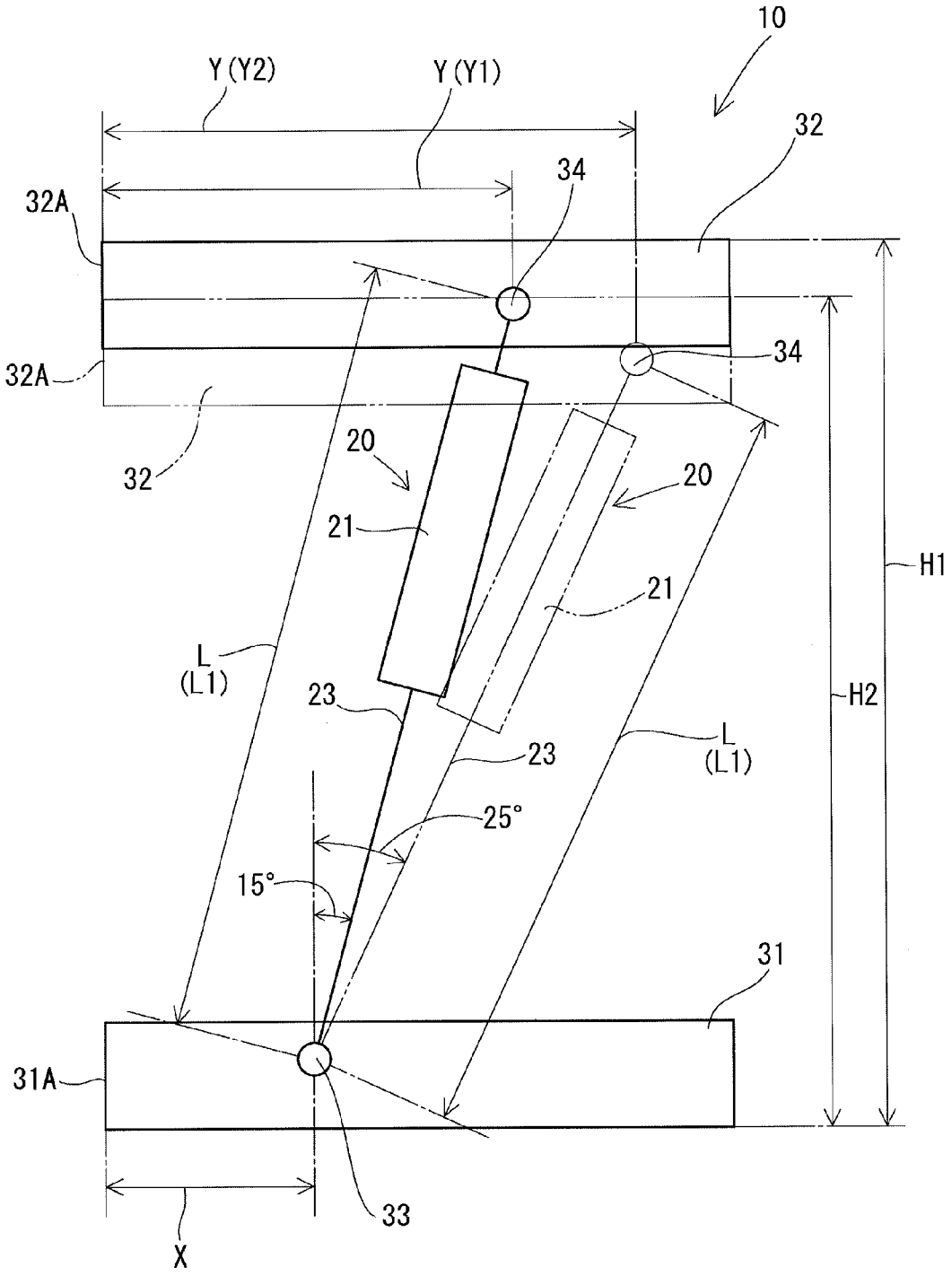
FIG. 2 is a side elevation of the overturn preventing device of the first embodiment.

As illustrated in FIG. 2, the following relationship of formula 2 is obtained when reference symbol X designates the distance from the first abutting surface 31A to the first connection 33, reference symbol L1 designates the length of the damper 20, and reference symbol Y designates the distance from the second abutting surface 32A to the second connection 34:

$$X+L1\sin 15^\circ \leq Y \leq X+L1\sin 25^\circ \qquad 2$$

In FIG. 2, X+L1 sin 15°=Y1 and X+L1 sin 25°=Y2. Here, the length L1 of the damper 20 is obtained when the overturn preventing device 10 is disposed between the top surface 1U of the furniture 1 and the ceiling C. In this case, the damper 20 is compressed to be shorter than the longest state (a maximum extended state) with the result that an expansive force of the compression gas filling the cylinder 21 acts in the extension direction. The damper 20 can exert a maximum damping force when set to the length L1. The second connection 34 of the second base portion 32 is formed so as to fall in a range which is not less than distance Y1 and not more than distance Y2 from the second abutting surface 32A, so that the relationship of formula 2 is met.

The overturn preventing device 10 having the above-described construction is mounted on the furniture 1 in which the distance between the top surface 1U of the furniture 1 and the ceiling C ranges from H1 to H2, whereby the overturn preventing device 10 can be mounted while an axis line of the damper 20 is inclined at an angle ranging from 15° (equal to or larger than 15°) to 25° (equal to or smaller than 25°).

Next, the following will describe a method of mounting the overturn preventing device 10 between the top surface 1U of the furniture 1 and the ceiling C. A first step is carried out in which the furniture side abutting surface 31B of the first base portion 31 is brought into surface contact with the top surface 1U of the furniture 1, so that the first base portion 31 is placed on the furniture 1, and the first abutting surface 31A is caused to abut against the wall surface W, so that the first base portion 31 is mounted. Subsequently, a second step is carried out in which the ceiling side abutting surface 32B of the second base portion 32 is brought into surface contact with the ceiling C and the second abutting surface 32A is caused to abut against the wall surface W, so that the second base portion 32 is mounted while the damper 20 is caused to be compressed from the state maximum extended by the expansive force of the compression gas filling the cylinder 21. Thus, the overturn preventing device 10 can be mounted between the top surface 1U of the furniture 1 and the ceiling C while the axis line of the damper 20 is inclined at an angle ranging from 15° to 25° with respect to the vertical direction.

Thus, the overturn preventing device 10 mounted between the top surface 1U of the furniture 1 and the ceiling C can suppress an amount of tilt of the furniture 1 thereby to prevent overturn of the furniture 1 since a force resulting from quakes of earthquake or the like and tilting the furniture 1 forward is damped by a damping force generated by the damper 20 during the compressing operation.

Second Embodiment

Figure 3:
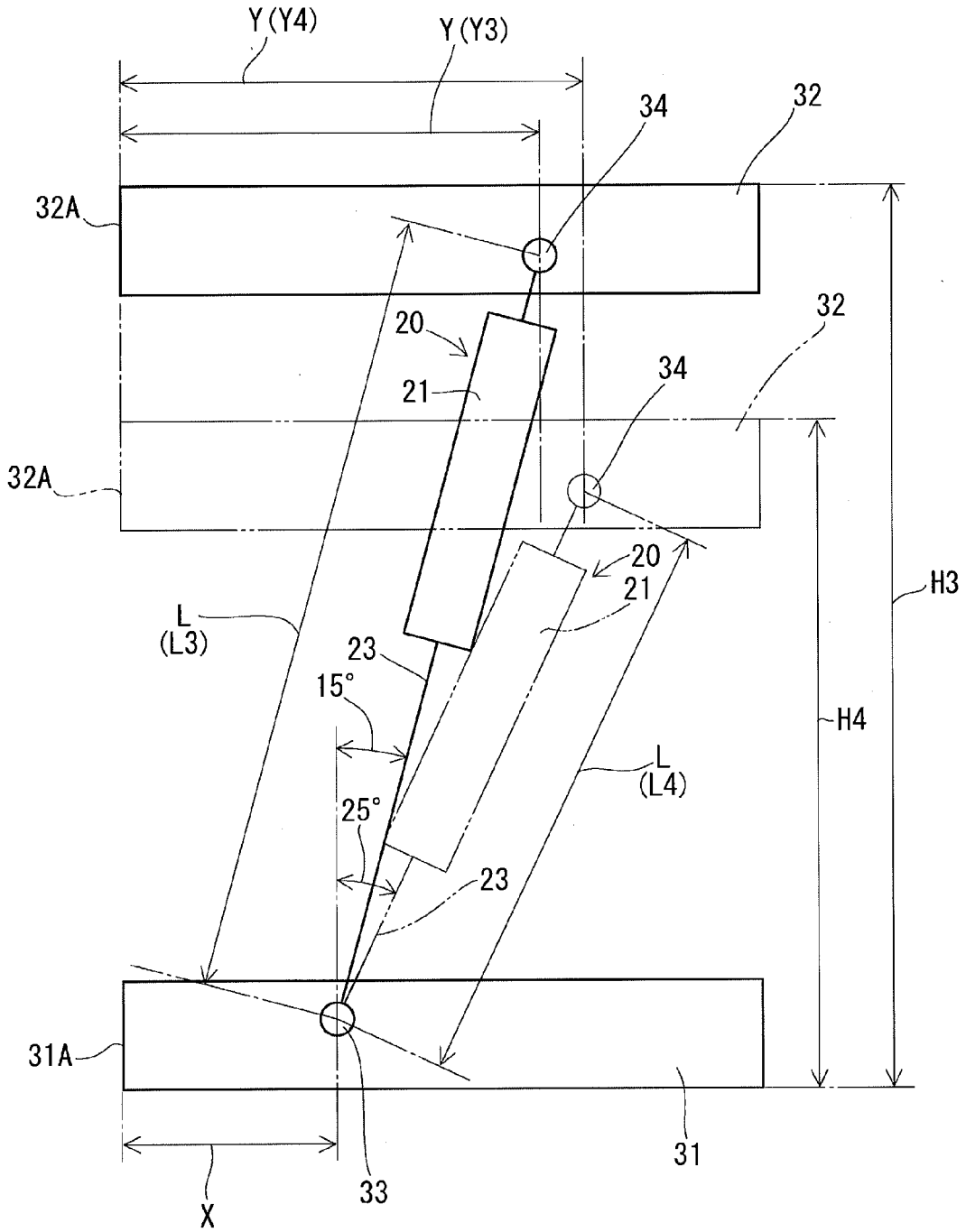
FIG. 3 is a side elevation of the overturn preventing device of the second embodiment.

The overturn preventing device 10 of a second embodiment is identical with the first embodiment in the form but differs from the first embodiment in an attitude to the length L of the damper 20 in formula 1, as illustrated in FIG. 3. Identical or similar constructions in the second embodiment are labeled by the same reference symbols as those in the first embodiment and detailed description of these constructions will be eliminated.

In the overturn preventing device 10 of the second embodiment, the angle at which the axis line of the damper 20 extends with respect to the vertical direction is gradually increased when the damper 20 is compressed while the first and second base portions 31 and 32 are parallel to each other. Accordingly, two cases are considered in order to mount the overturn preventing device 10 while the axis line of the damper 20 is inclined at an angle ranging from 15° to 25° with respect to the vertical direction. In one of the cases, the damper 20 is mounted with the longest length (a maximum extended state), and in the other case, the damper 20 is mounted with the shortest length (a maximum compressed state). That is, when the damper 20 is mounted between the top surface 1U of the furniture 1 in the maximum extended state (the length L3), assume that the angle at which the axis line of the damper 20 extends with respect to the vertical direction is 15°. Furthermore, when the damper 20 is mounted between the top surface 1U of the furniture 1 and the ceiling C in the maximum compressed state (the length L4), assume that the angle at which the axis line of the damper 20 extends with respect to the vertical direction is 25°. When the above-described relationship is applied to formula 1, the following formula 3 is obtained:

$$X+L3\sin 15° \leq Y \leq X+L4\sin 25° \quad (3)$$

In FIG. 3, X+L3 sin 15°=Y3 and X+L4 sin 25°=Y4. The second connection 34 of the second base portion 32 is formed so as to fall into a range which is not less than distance Y3 and not more than distance Y4 from the second abutting surface 32A, so that the relationship of formula 3 is met.

The overturn preventing device 10 having the above-described construction can be mounted while the axis line of the damper 20 is inclined at the angle ranging from 15° to 25° by being mounted on the furniture 1 in which the distance between the top surface 1U of the furniture 1 and the ceiling C ranges from H3 to H4, by the same mounting method as the first embodiment.

Furthermore, the overturn preventing device 10 of the second embodiment can also suppress an amount of tilt of the furniture 1 thereby to prevent overturn of the furniture 1 since a force resulting from quakes of earthquake or the like and tilting the furniture 1 forward is damped by a damping force generated by the damper 20 during the compressing operation. Furthermore, when the damper 20 is mounted between the top surface 1U of the furniture 1 in the maximum compressed state (the length L4), the damper 20 is mounted in a stretched state, with the result that the overturn preventing device 10 can prevent the furniture 1 from being tilted forward due to quakes of earthquake or the like thereby to be overturned.

The overturn preventing device 10 of each of the first and second embodiments includes the damper 20, the first base portion 31 and the second base portion 32. The damper 20 is mounted between the top surface 1U of the furniture 1 installed on the floor surface and the ceiling C while the rear surface 1B of the furniture 1 is opposed to the wall surface W extending in the vertical direction from the floor surface. The first base portion 31 has the first abutting surface 31A which abuts against the wall surface W and the first connection 33 to which one of the damper 20 is rotatably connected. The first base portion 31 is mounted on the top surface 1U of the furniture 1. The second base portion 32 has the second abutting surface 32A which abuts against the wall surface W and the second connection 34 to which the other end of the damper 20 is rotatably connected. The second base portion 32 is mounted on the ceiling C. The distance between the second abutting surface 32A and the second connection 34 of the second base portion 32 is longer than the distance between the first abutting surface 31A and the first connection 33 of the first base portion 31.

In this overturn preventing device 10, the following relationship of formula 1 is obtained when reference symbol X designates the distance from the first abutting surface 31A to the first connection 33 of the first base portion 31, reference symbol L designates the length of the damper 20, and reference symbol Y designates the distance from the second abutting surface 32A to the second connection 34 of the second base portion 32:

$$X+L\sin 15° \leq Y \leq X+L\sin 25° \quad (1)$$

The distance Y from the second abutting surface 32A to the second connection 34 of the second base portion 32 is specified so that the relationship of formula 1 is met, and the overturn preventing device 10 is mounted between the top surface U1 of the furniture 1 and the ceiling C while the first abutting surface 31A of the first base portion 31 and the second abutting surface 32A of the second base portion 32 are caused to abut against the wall surface W. As a result, the overturn preventing device 10 can be mounted while the axis line of the damper 20 with respect to the vertical direction is inclined at an angle ranging from 15° to 25°.

Accordingly, the overturn preventing device 10 of each of the first and second embodiments can be easily mounted between the top surface 1U of the furniture 1 and the ceiling C while the axis line of the damper 20 with respect to the vertical direction is inclined at an angle ranging from 15° to 25°, by the mounting method of each of embodiments 1 and 2.

The present invention should not be limited to the first and second embodiments described above with reference to the drawings, but the technical scope of the invention encompasses the following embodiments, for example.

(1) Although the damper is the compression damper in each of the first and second embodiments, the damper may be a bidirectional damper or an extension damper. When the extension damper is used, the first base portion is fixed to the ceiling and the second base portion in which the distance between the second abutting surface and the second connection is longer than the distance between the first abutting portion and the first connection of the first base portion is fixed to the top surface of the furniture (the article). Consequently, since a force forwardly tilting the furniture (the article) due to quakes of earthquake or the like is damped by a damping force generated by the damper during extension, an amount of tilt of the furniture (the article) is suppressed with the result that the furniture (the article) can be prevented from being overturned.

(2) Although the first and second base portions have the same shape in each of the first and second embodiments, the first and second base portions may have different shapes as long as the first and second base portions have the abutting surfaces abutting against the wall surface, the abutting surfaces abutting against the top surface of the furniture or the ceiling and the connections to which one or the other end of the damper is rotatably connected, respectively.

(3) Although the first and second base portions extend in the same shape forward from the first or second abutting surface abutting against the wall surface in the first and second embodiments, the forces applied to the top surface of the furniture and the ceiling upon tilt of the furniture due to quakes of earthquake or the like may be dispersed by increasing areas of the first and second abutting surfaces near the first and second connections, respectively.

EXPLANATION OF REFERENCE SYMBOLS

W . . . wall surface, 1 . . . furniture (article), 1B . . . rear surface (of the furniture), 1U . . . top surface (of the furniture), C . . . ceiling, 10 . . . overturn preventing device, 20 . . . damper, 31 . . . first base portion, 31A . . . first abutting surface, 33 . . . first connection, 32 . . . second base portion, 32A . . . second abutting surface and 34 . . . second connection.

The invention claimed is:

1. An overturn preventing device configured to be mounted between a top surface of an article and a ceiling to prevent the article from overturn, the article being installed on an installation surface with a rear surface thereof being opposed to a wall surface extending in a vertical direction from the installation surface, the device comprising:

a damper;

a first base portion configured to have a first abutting surface abutting against the wall surface and a first connection to which one of two ends of the damper is rotatably connected, the first base portion configured to be mounted on one of the top surface of the article and the ceiling; and a second base portion configured to have a second abutting surface abutting against the wall surface and a second connection to which the other end of the damper is connected, the second base portion configured to be mounted on the other of the top surface of the article and the ceiling, wherein a distance between the second abutting surface and the second connection is longer than a distance between the first abutting surface and the first connection; and wherein a relation among X, Y and L is expressed by a formula:

$$X+L\sin 15° \leq Y \leq X+L\sin 25° \quad (1)$$

where reference symbol X designates the distance from the first abutting surface to the first connection, reference symbol L designates a length of the damper and reference symbol Y designates the distance from the second abutting surface to the second connection.

2. The overturn preventing device according to claim 1, wherein the first and second base portions have an identical shape.

3. A method of mounting the overturn preventing device as specified in claim 1, comprising:

a first step of causing one of the first and second abutting surfaces to abut against the wall surface and mounting a corresponding one of the first and second base portions on one of the top surface of the article and the ceiling; and a second step of causing the other of the first and second abutting surfaces to abut against the wall surface and mounting the other of the first and second base portions on the other of the top surface of the article and the ceiling while the damper is in a stretched state.

* * * * *